US010029309B2

(12) United States Patent
Schloffer et al.

(10) Patent No.: US 10,029,309 B2
(45) Date of Patent: Jul. 24, 2018

(54) PRODUCTION PROCESS FOR TIAL COMPONENTS

(71) Applicant: MTU Aero Engines AG, Munich (DE)

(72) Inventors: Martin Schloffer, Munich (DE); Wilfried Smarsly, Munich (DE)

(73) Assignee: MTU AERO ENGINES AG, Munich (DE)

( * ) Notice: Subject to any disclaimer, the term of this patent is extended or adjusted under 35 U.S.C. 154(b) by 299 days.

(21) Appl. No.: 14/838,802

(22) Filed: Aug. 28, 2015

(65) Prior Publication Data

US 2016/0059312 A1 Mar. 3, 2016

(30) Foreign Application Priority Data

Sep. 1, 2014 (EP) ..... 14182981

(51) Int. Cl.

| | |
|---|---|
| ***B22F 3/15*** | (2006.01) |
| ***B22F 5/00*** | (2006.01) |
| ***B22F 5/04*** | (2006.01) |
| ***C22C 1/04*** | (2006.01) |
| ***B22D 7/00*** | (2006.01) |
| ***B22D 29/00*** | (2006.01) |
| ***B22F 9/02*** | (2006.01) |
| ***B22F 9/08*** | (2006.01) |
| ***B22F 9/14*** | (2006.01) |
| ***C22C 1/02*** | (2006.01) |
| ***C22C 14/00*** | (2006.01) |
| ***C22F 1/18*** | (2006.01) |
| ***C25F 5/00*** | (2006.01) |

(52) U.S. Cl.

CPC ..... *B22F 3/15* (2013.01); *B22D 7/005* (2013.01); *B22D 29/00* (2013.01); *B22F 5/009* (2013.01); *B22F 5/04* (2013.01); *B22F 9/02* (2013.01); *B22F 9/08* (2013.01); *B22F 9/14* (2013.01); *C22C 1/02* (2013.01); *C22C 1/0416* (2013.01); *C22C 1/0458* (2013.01); *C22C 14/00* (2013.01); *C22F 1/183* (2013.01); *C25F 5/00* (2013.01); *B22F 2202/13* (2013.01); *B22F 2301/205* (2013.01); *B22F 2998/10* (2013.01)

(58) Field of Classification Search

None

See application file for complete search history.

(56) References Cited

U.S. PATENT DOCUMENTS

| | | | | |
|---|---|---|---|---|
| 4,094,672 | A * | 6/1978 | Fleck | B22F 3/1241 264/DIG. 50 |
| 4,834,942 | A * | 5/1989 | Frazier | C22C 1/002 148/437 |
| 5,098,484 | A | 3/1992 | Eylon et al. | |
| 5,424,027 | A | 6/1995 | Eylon | |
| 5,768,679 | A | 6/1998 | Taguchi et al. | |
| 5,863,670 | A * | 1/1999 | Taguchi | B22F 7/02 428/550 |
| 2006/0083653 | A1* | 4/2006 | Das | B22F 3/15 419/36 |
| 2007/0125639 | A1* | 6/2007 | Cosack | C23C 14/165 204/192.16 |
| 2013/0248061 | A1* | 9/2013 | Kelly | C22C 14/00 148/707 |
| 2016/0138423 | A1* | 5/2016 | Ottow | B22F 5/009 415/200 |

FOREIGN PATENT DOCUMENTS

| | | |
|---|---|---|
| JP | 2006009062 A | 1/2006 |
| JP | 2008208432 A | 9/2008 |

* cited by examiner

*Primary Examiner* — George Wyszomierski

(74) *Attorney, Agent, or Firm* — Abel Law Group, LLP

(57) ABSTRACT

The present invention relates to a process for producing a component, in particular a component for a turbomachine, composed of a TiAl alloy, which comprises the following:

- introduction of a powder of the TiAl alloy into the capsule whose shape corresponds to the shape of the component to be produced and closing of the capsule,
- hot isostatic pressing of the capsule together with the powder,
- heat treatment of the hot isostatically pressed capsule,
- removal of the capsule,
- post-working of the contour of the component by removal of material.

19 Claims, No Drawings

PRODUCTION PROCESS FOR TIAL COMPONENTS

CROSS-REFERENCE TO RELATED APPLICATIONS

The present application claims priority under 35 U.S.C. § 119 of European Patent Application No. 14182981.2, filed Sep. 1, 2014, the entire disclosure of which is expressly incorporated by reference herein.

BACKGROUND OF THE INVENTION

1. Field of the Invention

The present invention relates to a process for producing a component, in particular a component for a turbomachine, for example an aircraft engine, composed of a high-temperature material, in particular a TiAl alloy.

2. Discussion of Background Information

The operation of turbomachines requires, owing to the use conditions of the components employed with sometimes high temperatures, aggressive environments and high forces acting on the components, specific materials for particular components, which materials are optimally matched to the use both in terms of their chemical composition and also their microstructure.

Alloys based on intermetallic titanium aluminide compounds (TiAl alloys) are used in the construction of turbomachines such as stationary gas turbines or aircraft engines, for example as material for turbine blades, since they have the mechanical properties required for this use and additionally have a low specific gravity, so that the use of such alloys can increase the efficiency of stationary gas turbines and aircraft engines. Accordingly, there are already many TiAl alloys and processes for producing corresponding components therefrom.

Components made of TiAl alloys can, like comparable components composed of other high-temperature alloys, for example alloys based on Ni, Fe or Co, be produced both pyrometallurgically and powder-metallurgically.

In pyrometallurgical production, the alloy used for producing the component is provided in the form of a melt and this is cast into a mold. The cast material usually has to be subjected to suitable deformation operations and/or heat treatments in order to destroy the cast microstructure and obtain a desired microstructure of the material. The corresponding component can then be brought to the desired shape by suitable after-working, for example by cutting machining or electrochemical working.

In powder-metallurgical production, the production steps comprise, in addition to or as an alternative to the individual steps of pyrometallurgical production, the use of powder materials in order to produce a desired composition of the material, for example by mechanical alloying. An example of the production of an object composed of a TiAl alloy using powder materials is described in U.S. Pat. No. 5,424,027, the entire disclosure of which is incorporated by reference herein.

According to this document, objects composed of TiAl alloys comprising 50 at. % of aluminum and also alloys comprising 48 at. % of aluminum and 1 at. % of niobium, 48 at. % of aluminum, 2 at. % of niobium and 2 at. % of chromium and also 48 at. % of aluminum, 1 at. % niobium and 1 at. % of vanadium and 48 at. % of aluminum, 3 at. % of niobium, 2 at. % of chromium and 1 at. % of manganese and in each case titanium as balance are produced by introducing an appropriately prealloyed TiAl powder into a suitable mold in order to be hot isostatically pressed subsequently. After hot isostatic pressing, the material is subjected to hot forming in order to produce a fine, uniform and isotropic microstructure.

For hot forming, which can be carried out both in pyrometallurgical production and in powder-metallurgical production as described in U.S. Pat. No. 5,424,027 or has to be carried out in order to achieve particular properties, a high outlay in respect of the hot forming steps is necessary. In addition, such a production method is associated with a high consumption of materials since near-net-shape production, for example by near-net-shaped casting, is not possible. In this context, there is then a further, increased outlay for cutting machining or electrochemical shaping of the component.

In view of the foregoing, it would be advantageous to have available a process for producing a component composed of a high-temperature alloy, in particular a TiAl alloy, by means of which a component can be produced efficiently with a reduction of the outlay compared to the prior art, with the material of the component having an optimal microstructure, in particular a homogeneous and uniform microstructure, so that the component likewise has uniform mechanical properties. The corresponding process should be able to be carried out simply and reliably and reproducibly allow suitable microstructures of high-temperature alloys and in particular TiAl alloys to be set so as to provide the required properties, in particular for components of turbomachines.

SUMMARY OF THE INVENTION

The present invention provides a process for producing a component, in particular a component for a turbomachine, of a TiAl alloy. The process comprises, in the order indicated:

- introduction of the powder of the TiAl alloy into a capsule whose shape corresponds to the shape of the component to be produced and closing of the latter,
- hot isostatic pressing of the capsule together with the powder,
- heat treatment of the hot isostatically pressed capsule,
- removal of the capsule,
- post-working of the contour of the component by removal of material.

In one aspect of the process of the present invention, the production of the powder may have comprised at least one of the following steps, preferably all steps, in the order indicated:

- pressing of starting materials or melting of prealloys which consist of or comprise the components to be alloyed,
- melting of the alloy by single or multiple plasma arc melting (PAM) or vacuum arc remelting (VAR) or vacuum induction melting (VIM),
- atomization of the alloy to produce the powder from a melt bath or with the aid of a cast ingot, in particular using one of the methods of vacuum inert gas atomization (VIGA), plasma melting induction guiding atomization (PIGA), electron induction gas atomization (EIGA) and plasma rotating electrode process (PREP),
- classification of powder fractions and selection of one or more powder fractions having average or maximum particle diameters or maximum dimensions smaller than or equal to 150 μm, in particular smaller than or equal to 125 μm, in particular particles having maximum or average diameters in the range from 15 to 150 μm or preferably from 45 to 125 μm, and purification of the powder in a plasma purification process.

In another aspect of the process, the capsule may be formed of titanium or a Ti alloy and/or the capsule may be formed by at least two shaped parts which are, in particular, welded to one another, preferably under protective gas.

In yet another aspect of the process, the capsule may be overdimensioned relative to the component to be produced and/or the introduction of the powder may be carried out under protective gas or under reduced pressure.

In a still further aspect of the process, the powder before introduction into the capsule or the filled but not yet closed capsule may be subjected to a heat treatment under reduced pressure, in particular a heat treatment at a temperature in the range from 200° C. to 500° C., e.g., from 440° C. to 460° C., and a pressure of not more than $10^{-3}$ mbar, e.g., less than or equal to $10^{-5}$ mbar.

In another aspect of the process of the present invention, the cooling after the heat treatment may be carried out at a cooling rate of from 25° C./min to 35° C./min, in particular 30° C./min, down to a temperature of 120° C. or less, e.g., 100° C. or less.

In another aspect of the process, the packing density of the powder in the capsule may be increased by mechanical excitation before or after closing.

In another aspect, the hot isostatic pressing may be carried out in the temperature range from 1100° C. to 1400° C., e.g., in the range from 1150° C. to 1300° C., at a pressure of from 100 to 250 MPa for from 2 to 6 hours.

In another aspect, a heat treatment, in particular a multistage heat treatment, may be carried out after the hot isostatic pressing. For example, the heat treatment may comprise at least one of the following heat treatments, preferably all heat treatments in the order indicated:

a solution heat treatment at a temperature of up to 1400° C. for from 15 to 45 minutes, a high-temperature heat treatment at a temperature of from 1100° C. to 1300° C. for from 15 to 120 minutes and an aging heat treatment at a temperature of from 850° C. to 1100° C. for from 6 to 100 hours.

In yet another aspect of the process of the present invention, a net-shape component or near-net-shape component may be produced by the hot isostatic pressing.

In another aspect of the process, the removal of the capsule may be effected by chemical pickling, electrochemical treatment and/or mechanical working.

In another aspect, the after-working of the contour may be carried out by cutting machining, in particular milling, and/or by electrochemical treatment.

In another aspect of the process, the component may be provided with one or more suitable functional layers.

In another aspect of the process, the component and/or the material from which the component has been produced may be characterized, e.g., characterized by X-ray diffraction.

In another aspect of the process, the alloy may comprise one or more elements from the group of Nb, Mo, W, Co, Cr, V, Zr, Si, C, Er, Gd, Hf, Y, B. For example, the alloy may comprise the main constituents Ti and Al together with one or more of the following elements in the concentrations indicated and may, apart from unavoidable impurities, be formed by these:

| | |
|---|---|
| W | from 0 to 3 at. % and/or |
| Si | from 0.2 to 0.35 at. % and/or |
| C | from 0 to 0.6 at. % and/or |
| Zr | from 0 to 6 at. % and/or |
| Y | from 0 to 0.5 at. % and/or |
| Hf | from 0 to 0.3 at. % and/or |
| Er | from 0 to 0.5 at. % and/or |
| Gd | from 0 to 0.5 at. % and/or |
| B | from 0 to 0.2 at. % and/or |
| Nb | from 4 to 25 at. % and/or |
| Mo | from 1 to 10 at. % and/or |
| W | from 0.5 to 3 at. % and/or |
| Co | from 0.1 to 10 at. % and/or |
| Cr | from 0.5 to 3 at. % and/or |
| V | from 0.5 to 10 at. %. |

The present invention also provides a component, in particular a component for a turbomachine, which component is made by the process of the present invention as set forth above (including the various aspects thereof).

As set forth above, the present invention proposes producing a component, in particular a component for a turbomachine such as a stationary gas turbine or an aircraft engine, composed of a TiAl alloy by firstly producing a powder from the desired alloy, introducing this powder into a capsule whose shape largely corresponds to the shape of the component to be produced and hot isostatically pressing this capsule together with the powder which has been introduced and subjecting it to a heat treatment, so that the finished component is present after removal of the capsule and after-working of the component to produce the final shape by removal of material.

The process of the invention allows hot forming or forging of the material to be avoided, so that the outlay for production can be reduced. However, a homogeneous, uniform microstructure without segregation and precipitation coarsening which provides advantageous mechanical properties of the material for use in turbomachines can be produced at the same time.

The use of a near-net-shape capsule which thus takes into account or is close to the shape of the component to be produced makes it possible to avoid complicated after-working with removal of a large volume of excess material by removal of material so that the material usage and the associated expense can be reduced. The near-net-shape of the capsule merely has to take into account the subsequent working steps in which a comprehensive change in the shape of the component, as would be the case, for example, for any necessary hot forming, no longer takes place. For example, it is possible merely to provide a small overdimension relative to the final shape or contour of the component to be produced, which takes account of production-related deviations in hot isostatic pressing, the heat treatment or the removal of the capsule, so that the desired shape of the component can be obtained by the subsequent removal of material.

The use of powder makes it possible to achieve a fine microstructure having a small, homogeneously distributed grain size and a homogeneous element distribution since, for example, no textures are introduced by forging processes and the powder can be handled very well under reduced pressure and under protective gas and thus can be used and processed in appropriate purity. Here, processing under protective gas can be carried out in order to achieve a low proportion of impurities, for example oxygen contamination.

The above-described production process can, in particular, be used for TiAl alloys and especially highly alloyed TiAl alloys and/or TiAl alloys having high Al contents, for example Al contents of more than 30 at. % of Al, in particular more than 45 at. % of Al, preferably more than 50 at. % and up to 60 at. % of Al or more, since in the case of these alloys the formation of finely dispersed precipitates and a fine-grained, homogeneous microstructure can be achieved advantageously by means of the present process.

In the production of the powder for use in the present process, it is possible to use various starting materials such as powders of the individual elements to be alloyed or powder to be recycled or powder composed of a master alloy, i.e., alloys which comprise parts of the future alloyed composition. The starting materials can be pressed to form pressed bodies which can then be used for melting of the alloy.

The melting of the alloy can be carried out, for example, by single or multiple plasma arc melting (PAM), vacuum arc remelting (VAR) or vacuum induction melting (VIM). When melting the TiAl alloy, any possible depletion of the alloy in production and processing, for example as a result of burning off elements such as aluminum, can be taken into account during atomization and the alloy composition can thus be adapted correspondingly, i.e., for example, be provided with a higher proportion of Al.

The powder can be produced by atomization directly from the appropriate melt or after remelting after an intermediate casting of the melt from a melt bath or from an ingot cast as an intermediate. Processes which can be used include vacuum inert gas atomization (VIG), plasma melting induction guiding atomization (PIGA) or electrode induction gas atomization (EIGA).

The powder can also be subjected to an additional purification process, for example in order to reduce occupation of the powder surface by oxygen and thus oxygen contamination of the material used for component production and also to decrease or eliminate organic and/or inorganic impurities. In addition, processing of the powder particles to produce a spherical particle shape and/or influence the size of the particles (particle size) can be carried out during the purification process. For example, this can be carried out in a plasma purification process in which the powder particles are introduced into a plasma so that impurities are removed and the surface shape of the particles can approximate a sphere.

The powder produced can be classified according to particle size and one or more powder fractions can be selected for the further production of the component. Fractionation can be carried out before or after the purification process, with preference being given to purification before fractionation since the size of the particles can be altered by means of a plasma purification.

The fractionation can be carried out using various known methods; in particular, two-phase fractionation in which, for example, prefractionation is firstly carried out by means of a centrifuge and a main fraction is subsequently produced in a second step by sieving and/or sifting. For production of a fine-grained TiAl material, it is possible to select, in particular, powder fractions having average or maximum particle diameters or maximum dimensions of ≤125 μm.

The capsule into which the powder is introduced for the subsequent hot isostatic pressing can be made of a sheet of a material similar to that of the powder, in particular the base material of the powder used, i.e., for example, an alloy having the same main constituent. When a TiAl alloy is used for producing the component, the capsule can, for example, be formed by titanium or a titanium alloy and have a wall thickness of from 1 to 3 mm, preferably from 2 to 3 mm.

In addition, the capsule can be formed by at least two shape parts which can be joined to one another to close the capsule, for example by welding under protective gas.

The shape parts of the capsule can be formed by deep-drawn metal sheets of the corresponding capsule material, so that a contour of the capsule which is similar to the shape of the component to be produced can be produced in a simple way. As indicated above, the contour or shape of the capsule can be formed with a certain overdimension which takes into account the shape changes during subsequent hot isostatic pressing and the heat treatment or allows for subsequent after-working by removal of material so as to make it possible to produce the precise desired shape of the component.

The powder can be introduced into the capsule under protective gas in order to achieve a further reduction in the degree of contamination. In particular, the powder can be introduced into the capsule under reduced pressure of protective gas immediately after the purification, so that the powder is no longer exposed to the surrounding atmosphere.

In addition, the filled but not yet closed capsule, or alternatively the powder before introduction into the capsule, can be subjected to a heat treatment under reduced pressure (purification heat treatment) in order to bring about further purification of the powder material by evaporation or outgassing. For example, the heat treatment can be carried out at a temperature in the range from 200° C. to 500° C., e.g., from 440° C. to 460° C., under a reduced pressure of $\leq 10^{-3}$ mbar, in particular $\leq 10^{-5}$ mbar, over the powder. In this way, it is possible, for example, to reduce the oxygen content in the production of a component composed of a TiAl alloy to a range of ≤600 ppm.

The cooling of the surface of the capsule containing the introduced powder after the purification heat treatment can be carried out at a cooling rate of from 25° C./min to 35° C./min, preferably at about 30°/min, down to a temperature of 120° C. or below, in particular to about 100° C., under reduced pressure, with the closing of the capsule subsequently being able to be effected by, for example, welding under protective gas. The rapid cooling also improves the prevailing vacuum, i.e., lower pressures are generated, so that the purification of the powder can be further improved. For example, the vacuum can be improved from $10^{-3}$ mbar to $10^{-4}$ mbar.

In order to be able to control shrinkage and distortion, the powder can be compacted in the capsule by mechanical excitation such as vibration, shaking, tapping or the like. During this, the capsule can still be open or be closed; in the case of an open capsule, mechanical compacting can be carried out under reduced pressure.

The capsule which has been prepared in this way can be hot isostatically pressed at temperatures in the range from 1100° C. to 1400° C., in particular from 1150° C. to 1300° C., at a pressure of from 100 to 250 MPa for a time of from 2 to 6 hours so as to give a compacted block of material having a near-net-shape of the component.

The near-net-shape can be selected so that the component produced corresponds to the requirements for producing net-shape components or near-net-shape components. For example, the hot isostatically pressed capsule can have an overdimension relative to the finished component of from 0.5 mm to 5 mm, in particular from 0.5 mm or from 1 mm to 2 mm (net shape) or from 2 mm to 5 mm (near-net-shape) plus in each case the respective capsule thickness.

After hot isostatic pressing, the capsule can be subjected to a heat treatment, in particular a multistage heat treatment, in which a solution heat treatment, a high-temperature heat treatment and an aging heat treatment can be carried out in this order, depending on the powder material used. As an alternative, it is also possible to carry out only individual heat treatment steps.

When a TiAl alloy is used, a solution heat treatment can be carried out at a temperature up to 1400° C. for from 15 to 45 minutes. The high-temperature heat treatment can be carried out at a temperature of from 1100° C. to 1300° C. and an aging heat treatment can be carried out at a temperature of from 850° C. to 1100° C. for from six to one hundred hours.

The heating and/or cooling rates for the heat treatment can be selected as a function of the size and/or shape of the component, with, for example, rather lower heating and/or cooling rates being selected for relatively large components, while greater heating and/or cooling rates can be realized for small components. In addition, the heating and/or cooling rates can be set so that very little distortion of the component takes place.

After the heat treatment, the capsule can be removed, for example by chemical pickling, electrochemical treatment, blasting with particles, in particular with polymer granules, and/or cutting machining such as milling or grinding. The after-working of the outer shape (contour) of the component by cutting machining, in particular by milling, grinding, polishing, etc., and/or electrochemical treatment can then be carried out.

Various functional layers, for example one or more of wear protection layers, corrosion protection layers, oxidation protection layers and the like, can be applied to the component produced in this way.

During the process, the component and/or the material of which the component is made can be characterized, in particular by nondestructive methods such as X-ray diffraction.

For the purposes of the present invention, a TiAl alloy is a material comprising titanium and aluminum as main constituents. For the present purposes, main constituents are elements whose proportion in at. % or % by weight is the greatest, i.e. in the case of a TiAl alloy titanium and aluminum as elements present in the largest proportions in at. % or % by weight in the alloy. A TiAl alloy which is processed by the present process to form a component can be, in particular, a highly alloyed TiAl alloy which can be used, in particular, for high temperatures, e.g. as blade material for turbomachines. Accordingly, chemical elements such as niobium, molybdenum, tungsten, cobalt, chromium, vanadium, zirconium, silicon, carbon, erbium, gadolinium, hafnium, yttrium and boron can be present.

WORKING EXAMPLE

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description making apparent to those of skill in the art how the several forms of the present invention may be embodied in practice.

In a working example, a turbine blade of an aircraft engine composed of a highly alloyed TiAl alloy is made by the process of the invention, with a pressed body composed of powders of the individual elements to be alloyed and/or master alloys firstly being pressed in a first step. In addition, the pressed body can contain titanium sponge (process step I).

The pressed body is subsequently (process step II) melted by means of a single plasma arc melting process so as to give an alloy melt. This is firstly cast and subsequently melted a second time in a third process step (process step III) for powder production in order to be able to carry out gas atomization from the melt bath. The gas atomization from the melt bath can be effected by VIGA or PIGA processes, with preferably spherical powder particles being produced by the gas atomization.

In a fourth process step (process step IV), the particle size fractions desired for further processing, for example particle size fractions having maximum or average diameters of the particles in the range from 15 to 150 μm or preferably from 45 to 125 μm, are selected from the powder produced. In the case of the working example chosen, the particle size is maintained at 125 μm in order to achieve a fine-grained microstructure.

In a fifth process step (process step V), the selected powder fraction is introduced into a plasma so that purification of the powder particles and formation of spherical powder particles is effected by the plasma. For example, the occupation of the powder surface by oxygen is reduced and the surface shape is brought close to a spherical shape by the plasma.

The powder which has been purified in this way is introduced under protective gas, for example helium or argon, into titanium capsules (process step VI) which have, for example, a wall thickness of from 1 to 2 mm and are formed by, for example, two deep-drawn titanium sheets so as to correspond to the shape of the component to be produced. The titanium material used for the capsules can be titanium grade I material.

Before the capsule is closed by welding the capsule parts together in the ninth process step, a further purification of the material is carried out in a seventh process step (process step VII) by baking the capsule which has been filled with powder but not yet been closed at temperatures of up to 450° C. under vacuum conditions at a pressure of $\leq 10^{-3}$ mbar, in particular $\leq 10^{-5}$ mbar, in order to volatilize further impurities by evaporation. In this way, the oxygen content can be set to, for example, 600 ppm. From the baking temperature, the capsule which continues to be maintained under reduced pressure can be cooled to 120° C. or 100° C., with a cooling rate of 30° C./min being able to be selected (process step VIII).

In the ninth process step (process step IX), the capsule is closed by welding so that the capsule together with the powder enclosed therein can be hot isostatically pressed at a pressure in the range from 100 to 240 MPa and a temperature in the range from 1150° C. to 1400° C. for a time of from 2 to 6 hours in the tenth process step (process step X).

The hot isostatic pressing (process step X) is followed as eleventh process step (process step XI) by a multistage heat treatment by means of which the microstructure of the component can be adjusted. A solution heat treatment at 1400° C. or just below for a time of from 15 to 45 minutes is firstly carried out. A high-temperature heat treatment at from 1100° C. to 1300° C. is then carried out and, finally, an aging heat treatment at from 850° C. to 1100° C. for a time of from 6 to 100 hours is then carried out. The component is then finished in respect of the microstructure of the material and it is then merely necessary to carry out final work in respect of shaping of the component.

For this purpose, the capsule is removed by corroding away the outer layer and/or electrochemical treatment, blasting with particles, in particular polymer particles, and/or by mechanical working such as milling, grinding or the like in a twelfth process step (process step XII).

In a thirteenth process step (process step XIII), the excess material is then removed from the component by mechanical working, in particular cutting machining, for example by milling, grinding, polishing and the like. As an alternative, the removal of material can also be effected by electrochemical treatment so as to set the final dimensions.

The microstructure which has been set in the component can be checked by X-ray diffraction and other nondestructive test methods. Furthermore, required layers such as corrosion protection layers, oxidation protection layers, wear protection layers and the like can be deposited on the component.

Although the present invention has been described in detail with the aid of the working example, the invention is not restricted to this working example but instead it is possible to carry out modifications by leaving out individual features or implementing other combinations or features, as long as the scope of protection of the accompanying claims is not left. The present invention includes all combinations of the individual features presented.

Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for producing a component of a TiAl alloy, wherein the process comprises:

introduction of a powder of the TiAl alloy into a capsule whose shape corresponds to a shape of the component to be produced and closing of the capsule, hot isostatic pressing of the capsule together with the powder, heat treatment of the hot isostatically pressed capsule, removal of the capsule, post-working of a contour of the component by removal of material.

2. The process of claim 1, wherein the powder has been produced by a process which comprises at least one of the following:

pressing of starting materials or melting of prealloys which consist of or comprise components to be alloyed, melting of the alloy by one or more of single or multiple plasma arc melting (PAM), vacuum arc remelting (VAR), vacuum induction melting (VIM), atomization of the alloy to produce the powder from a melt bath or with the aid of a cast ingot, classification of powder fractions and selection of one or more powder fractions having average or maximum particle diameters or maximum dimensions smaller than or equal to 150 μm, and purification of the powder in a plasma purification process.

3. The process of claim 1, wherein the capsule is formed of titanium or a Ti alloy.

4. The process of claim 1, wherein the capsule is formed by at least two shaped parts.

5. The process of claim 1, wherein the capsule is overdimensioned relative to the component to be produced.

6. The process of claim 1, wherein the introduction of the powder is carried out under protective gas or under reduced pressure.

7. The process of claim 1, wherein the powder before introduction into the capsule or a filled but not yet closed capsule is subjected to a heat treatment under reduced pressure.

8. The process of claim 7, wherein cooling after the heat treatment is carried out at a cooling rate of from 25° C./min to 35° C./min down to a temperature of 120° C. or less.

9. The process of claim 1, wherein a packing density of the powder in the capsule is increased by mechanical excitation before or after closing of the capsule.

10. The process of claim 1, wherein the hot isostatic pressing is carried out in a temperature range of from 1100° C. to 1400° C. at a pressure of from 100 to 250 MPa for from 2 to 6 hours.

11. The process of claim 1, wherein the heat treatment of the hot isostatically pressed capsule comprises at least two of the following:

a solution heat treatment at a temperature of up to 1400° C. for from 15 to 45 minutes, a high-temperature heat treatment at a temperature of from 1100° C. to 1300° C. for from 15 to 120 minutes and an aging heat treatment at a temperature of from 850° C. to 1100° C. for from 6 to 100 hours.

12. The process of claim 11, wherein the heat treatment of the hot isostatically pressed capsules comprises at least:

a solution heat treatment at a temperature of up to 1400° C. for from 15 to 45 minutes, followed by a high-temperature heat treatment at a temperature of from 1100° C. to 1300° C. for from 15 to 120 minutes.

13. The process of claim 11, wherein the heat treatment of the hot isostatically pressed capsule comprises at least:

a high-temperature heat treatment at a temperature of from 1100° C. to 1300° C. for from 15 to 120 minutes, followed by an aging heat treatment at a temperature of from 850° C. to 1100° C. for from 6 to 100 hours.

14. The process of claim 11, wherein the heat treatment of the hot isostatically pressed capsule comprises, in the following order:

a solution heat treatment at a temperature of up to 1400° C. for from 15 to 45 minutes, a high-temperature heat treatment at a temperature of from 1100° C. to 1300° C. for from 15 to 120 minutes and an aging heat treatment at a temperature of from 850° C. to 1100° C. for from 6 to 100 hours.

15. The process of claim 1, wherein a net-shape component or near-net-shape component is produced by the hot isostatic pressing.

16. The process of claim 1, wherein the removal of the capsule is effected by at least one of chemical pickling, electrochemical treatment, mechanical working.

17. The process of claim 1, wherein the post-working of the contour is carried out by cutting machining and/or by electrochemical treatment.

18. The process of claim 1, wherein the process further comprises providing the component with one or more functional layers after the post-working of the contour of the component.

19. The process of claim 1, wherein the alloy comprises Ti and Al as main constituents together with one or more of up to 3 at. % W, from 0.2 to 0.35 at. % Si, up to 0.6 at. % C, up to 6 at. % Zr, up to 0.5 at. % Y, up to 0.3 at. % Hf, up to 0.5 at. % Er, up to 0.5 at. % Gd, up to 0.2 at. % B, from 4 to 25 at. % Nb, from 1 to 10 at. % Mo, from 0.1 to 10 at. % Co, from 0.5 to 3 at. % Cr, from 0.5 to 10 at. % V.

* * * * *